US005380389A

United States Patent [19]

Lo

[11] Patent Number: 5,380,389

[45] Date of Patent: Jan. 10, 1995

[54] METHOD FOR MANUFACTURING THE SHAFT UNIT OF A GOLF CLUB

[76] Inventor: Kun-Nan Lo, No. 33, Hsiang-Ho Rd., Li-Lin Tsun, Tan-Tzu Hsiang, Taichung Hsien, Taiwan, Prov. of China

[21] Appl. No.: 120,362

[22] Filed: Sep. 14, 1993

[51] Int. Cl.[6] ..... A63B 53/10

[52] U.S. Cl. ..... 156/188; 156/189; 156/190; 273/80 R; 273/80 B

[58] Field of Search ..... 156/172, 187, 188, 189, 156/190, 195; 273/80 R, 80.9, 80 A, 80 B, DIG. 3, DIG. 7, DIG. 23

[56] References Cited

U.S. PATENT DOCUMENTS

| | | | |
|---|---|---|---|
| 3,794,538 | 2/1974 | Christie et al. | 156/188 X |
| 3,998,458 | 12/1976 | Inoue et al. | 273/80 B |
| 4,000,896 | 1/1977 | Lauraitis | 273/80 R |
| 4,084,819 | 4/1978 | Van Auken | 273/80 R |
| 4,157,181 | 6/1979 | Cecka | 273/80 R |
| 4,938,824 | 7/1990 | Youngkeit | 156/189 X |
| 5,088,735 | 2/1992 | Shigetoh | 273/80 B |

*Primary Examiner*—Jeff H. Aftergut

*Attorney, Agent, or Firm*—Oblon, Spivak, McClelland, Maier & Neustadt

[57] ABSTRACT

A method for manufacturing the shaft unit of a golf club includes the following steps: (1) providing a shaft which has a first end surface, a second end surface, and a cross-sectional area that increases gradually from the first end surface to the second end surface; (2) providing an elongated first-layer sheet which is made of resin, and which has two inclined end surfaces that are parallel to each other and several fibers that are evenly coated on the sheet that extend along the length of the sheet; (3) winding the sheet on the shaft in a clockwise direction from the first end surface to the second end surface of the shaft in such a manner that one of the end surfaces of the sheet and the first end surface of the shaft are on a similar plane and that the fibers of the sheet form an angle of about 48±3 degrees with respect to an axis of the shaft so that, when the first-layer sheet is wound to the second end surface of the shaft, the fibers of the first-layer sheet form an angle of about 19±3 degrees with respect to the axis of the shaft; (4) winding a second-layer sheet on the shaft in a counterclockwise direction in the same manner as the first-layer sheet; and (5) pressurizing and heating assembly of the sheets and the shaft so as to form the golf club.

2 Claims, 5 Drawing Sheets

METHOD FOR MANUFACTURING THE SHAFT UNIT OF A GOLF CLUB

BACKGROUND OF THE INVENTION

1. Field of the Invention

The invention relates to a method for manufacturing the shaft unit of a golf club, more particularly to a manufacturing method which can produce a high quality shaft unit with a long-fiber composite material coated thereon.

2. Description of the Related Art

Referring to FIGS. 1, 2, and 3, a method for manufacturing the shaft unit of a conventional golf club includes the steps of:

(1) providing a shaft 1 which is made of metal and which has a cross-sectional area that increases gradually from an end surface to the other end surface, as shown in FIG. 1;

(2) providing an elongated first-layer sheet 10 which is made of resin and which has several fibers that are coated on the sheet 10 and that are oriented at an angle of about 45 degrees with respect to the sides of the sheet 10, as shown in FIG. 1;

(3) winding the sheet 10 on the shaft 1 in a clockwise direction in such a manner that one of the sides of the sheet 10 is parallel to the axis of the shaft 1 so that the fibers of the sheet 10 form an angle of about 45 degrees with respect to the axis of the shaft 1, as shown in FIGS. 2 and 3;

(4) providing an elongated second-layer sheet 10' which is similar to the sheet 10, the fibers being coated on the sheet 10' and being oriented at an angle of about 90 degrees with respect to the fibers of the sheet 10, as shown in FIG. 1;

(5) winding the sheet 10' on the shaft 1 in a counterclockwise direction in the same manner as the sheet 10 so that the fibers of the sheet 10' form an angle of about −45 degrees with respect to the axis of the shaft 1, as shown in FIGS. 2 and 3;

(6) providing an elongated third-layer sheet 10'' which is made of resin and which has several fibers coated on the sheet 10'' and that extend along the length of the sheet 10'', as shown in FIG. 1;

(7) winding the sheet 10'' on the shaft 1 in the same manner as the sheet 10; and (8) pressurizing and heating the assembly of the shaft 1 and the sheets 10, 10', 10'' so as to form the shaft unit of the golf club.

The above described conventional manufacturing process has several drawbacks. Referring to FIG. 4, 4, because the assembly of the sheets 10, 10', 10'' is in the form of a spiral, the conventional golf club which is made by the above manufacturing method has a seam 11 formed between the sheets 10 and 10' and a seam 12 formed between the sheet 10' and 10'' so that cracks easily occur in the seams 11 and 12. Accordingly, when the golf club is used, the sheets 10, 10', 10'' may separate from each other at the seams 11, 12 due to an impact on the sheets 10, 10', 10''. This results in decreased strength of the golf club.

SUMMARY OF THIS INVENTION

The main object of this invention is to provide a manufacturing method for the shaft unit of a golf club which can produce a high quality shaft unit with a long-fiber composite material coated thereon.

According to this invention, a manufacturing method for the shaft unit of a golf club includes the following steps:

(1) providing a shaft which is made of metal and which has a first end surface, a second end surface, and a cross-sectional area that increases gradually from said first end surface to said second end surface;

(2) providing an elongated first-layer sheet which is made of resin and which has two inclined end surfaces that are parallel to each other, and several fibers that are evenly coated on said sheet and that extend along the length of said sheet;

(3) winding said first-layer sheet on said shaft in a clockwise direction from said first end surface to said second end surface of said shaft in such a manner that one of said end surfaces of said first-layer sheet and said first end surface of said shaft are on a similar plane and that said fibers of said first-layer sheet form an angle of about 48±3 degrees with respect to an axis of said shaft so that, when said first-layer sheet is wound to said second end surface of said shaft, said fibers of said first-layer sheet form an angle of about 19±3 degrees with respect to said axis of said shaft;

(4) providing an elongated second-layer sheet which is similar to said first-layer sheet;

(5) winding said second-layer sheet on said shaft in a counterclockwise direction from said first end surface to said second end surface of said shaft in the same manner as said first-layer sheet; and (6) pressurizing and heating assembly of said sheets and said shaft so as to form said shaft unit.

BRIEF DESCRIPTION OF THE DRAWING

Other features and advantages of the present invention will become apparent in the following detailed description of a preferred embodiment, with reference to the accompanying drawings, of which.

DETAILED DESCRIPTION OF THE PREFERRED EMBODIMENT

Figure 1:
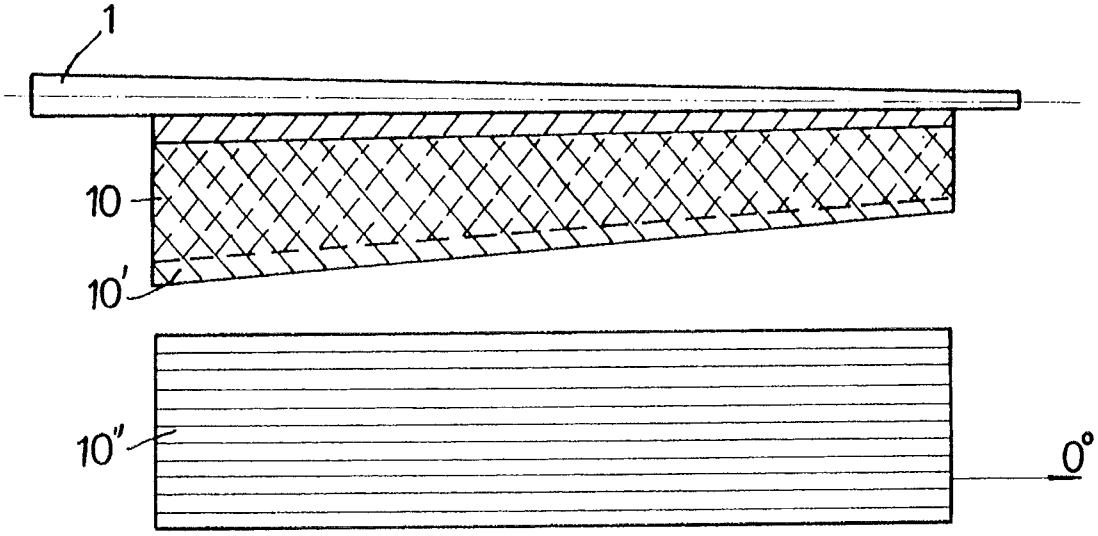
FIG. 1 PRIOR ART
FIG. 1 is a schematic view illustrating a method for manufacturing the shaft unit of a conventional golf club which has several sheets coated thereon.
Figure 2:
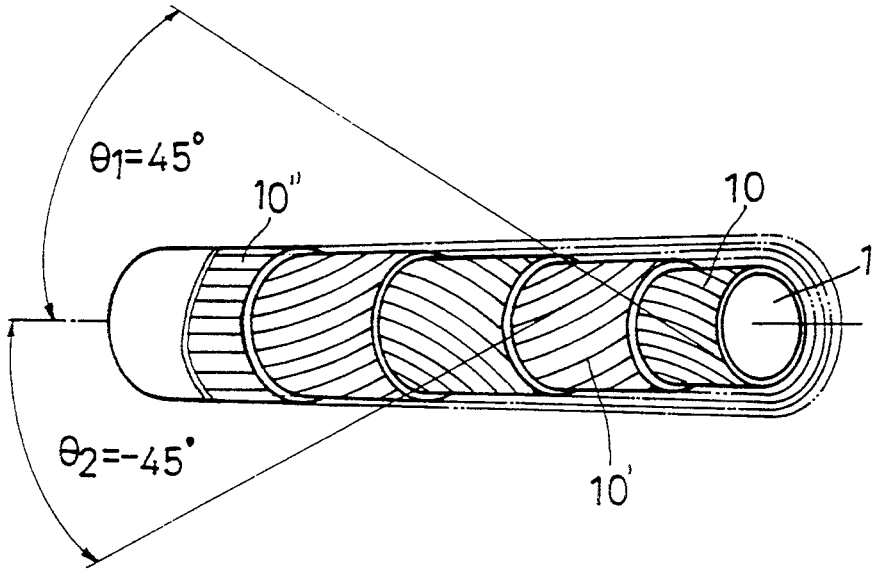
FIG. 2 PRIOR ART
FIGS. 2 and 3 illustrate how the sheets cover the shaft of the golf club in accordance with the conventional manufacturing method.
Figure 3:
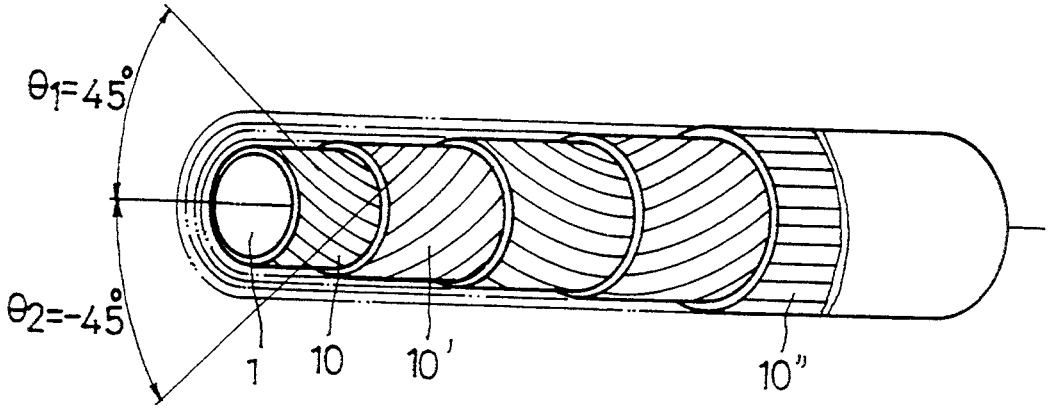
FIG. 3 PRIOR ART
Figure 4:
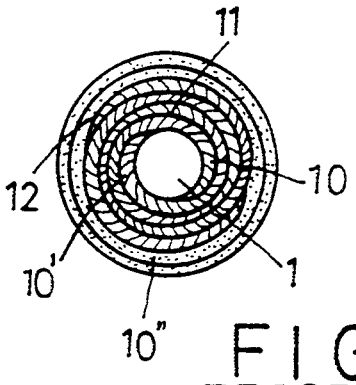
FIG. 4 PRIOR ART
FIG. 4 is a sectional view illustrating the junctions of the sheets of the conventional golf club.
Figure 5:
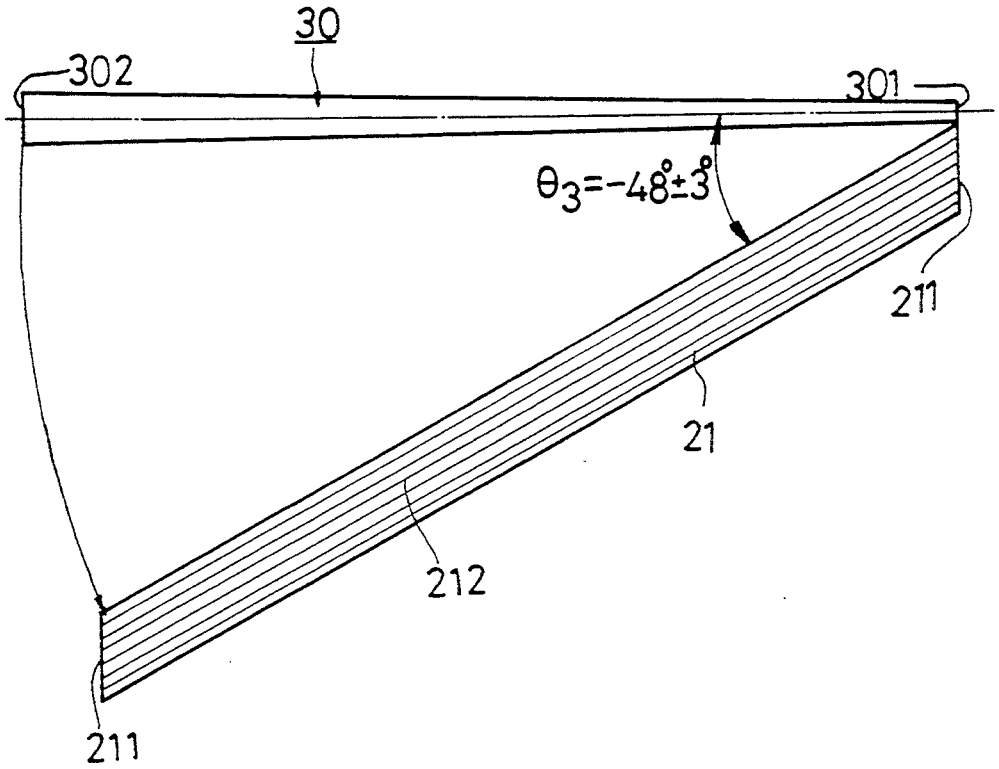
FIGS. 5 to 8 are schematic views illustrating the steps for manufacturing the shaft unit of a golf club according to a preferred embodiment of this invention.
Figure 6:
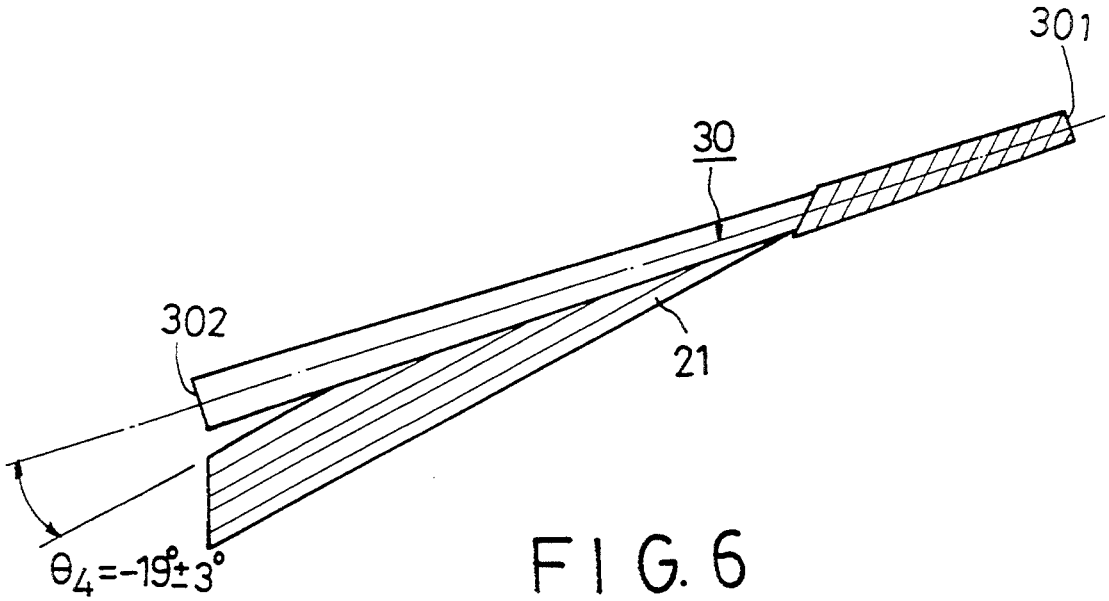
Figure 7:
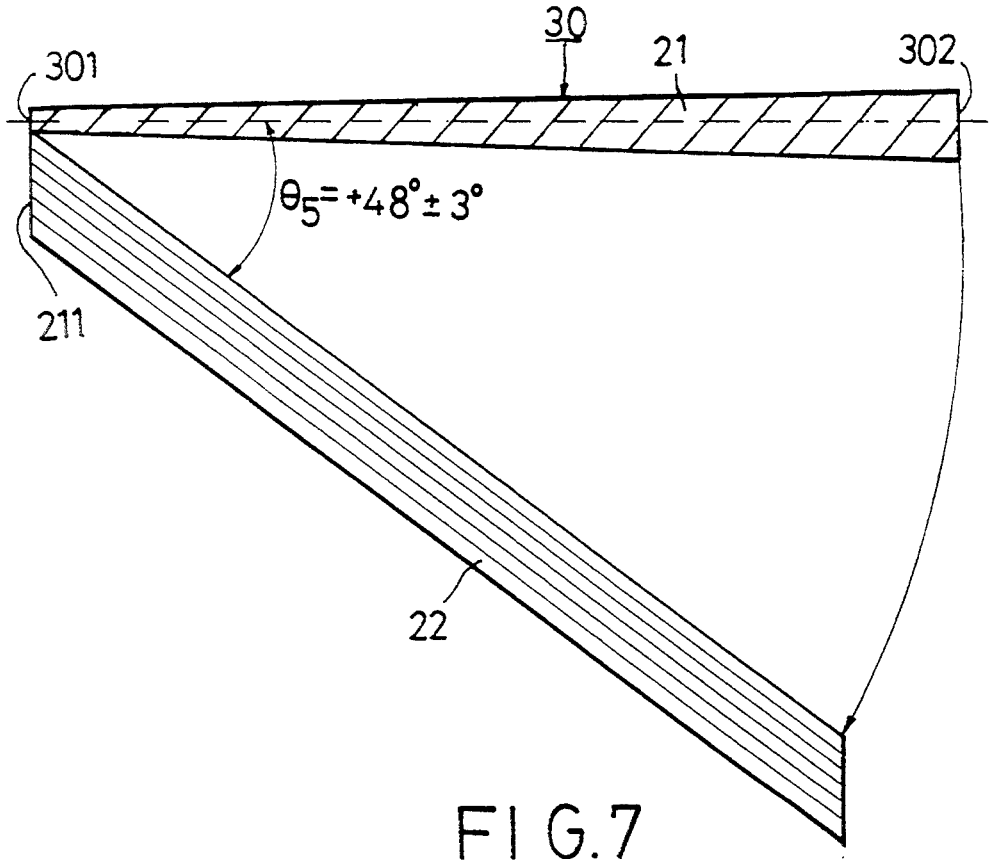
Figure 8:
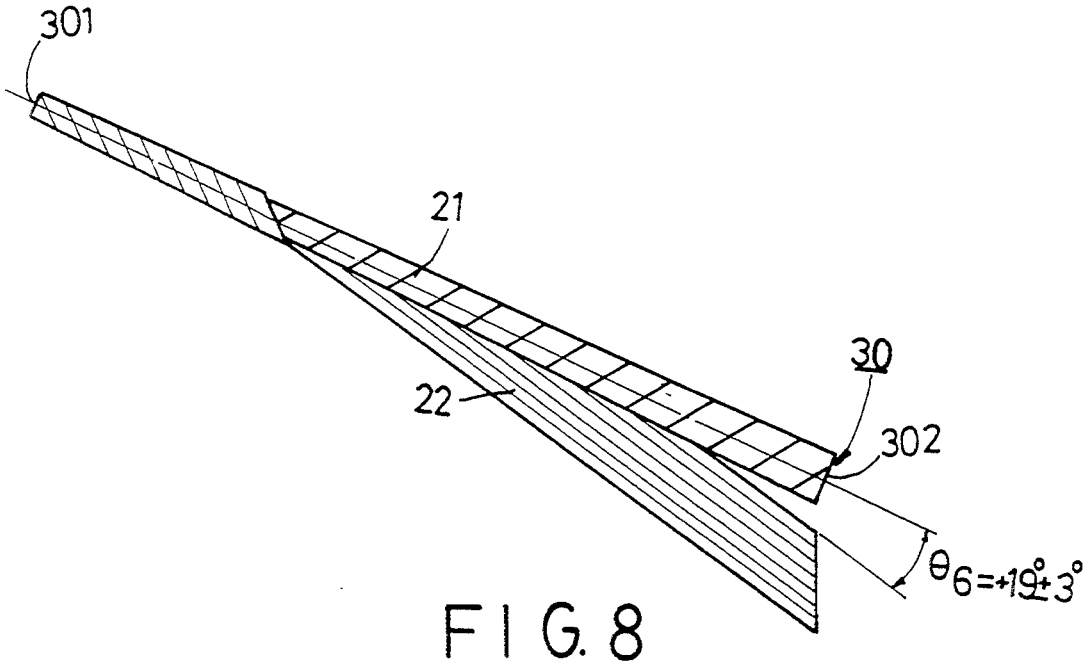
Figure 9:
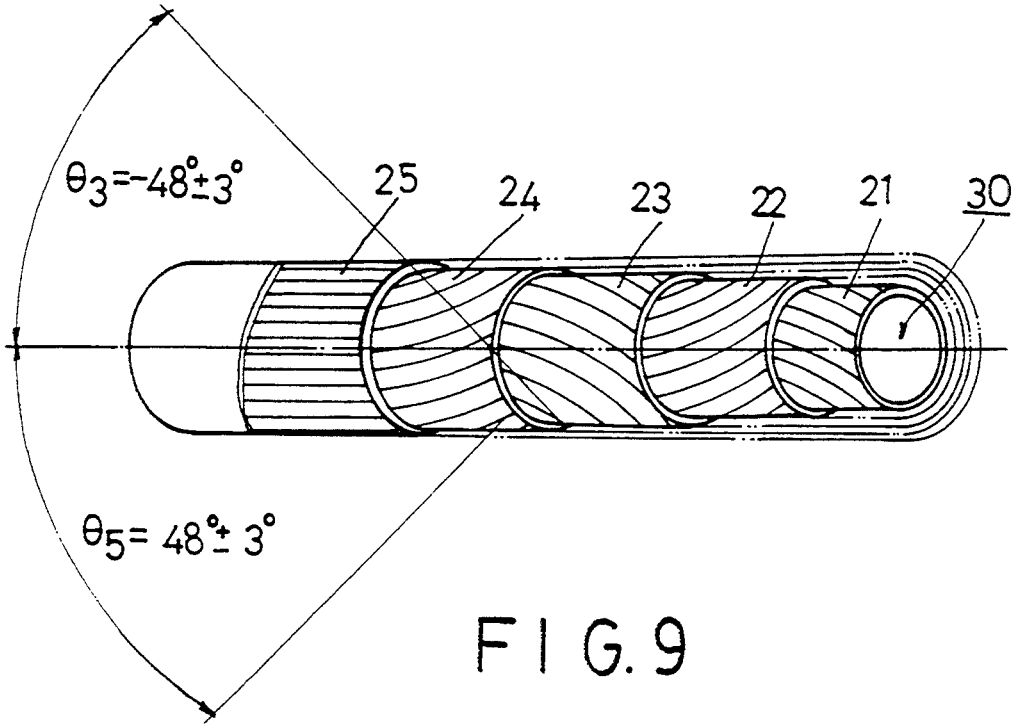
FIGS. 9 and 10 illustrate the angles between the axis of the shaft and the fibers of the sheets of the shaft of the golf club of this invention.
Figure 10:
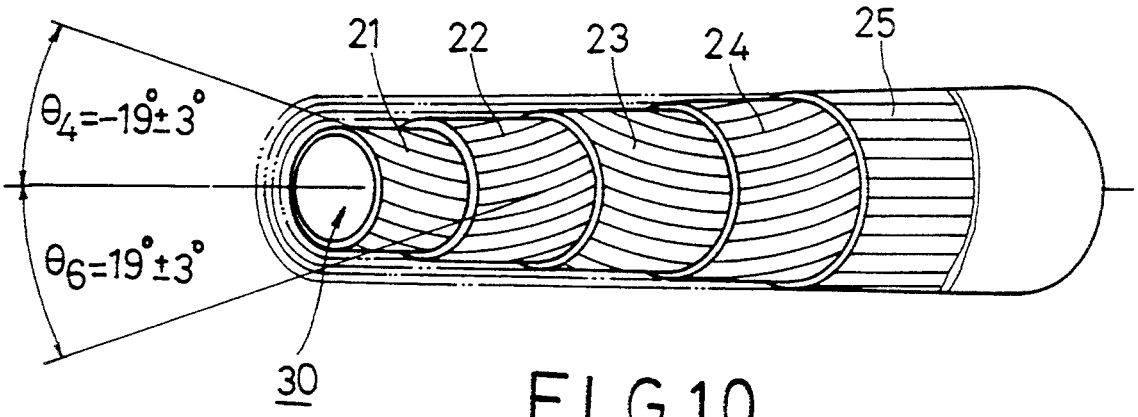

Referring to FIGS. 5 to 8, the preferred embodiment of a shaft unit manufacturing method according to this invention includes the following steps:

(1) providing a shaft 30 which is made of methyl and which has a first end surface 301, a second end surface 302, and a cross-sectional area that increases gradually from the first end surface 301 to the second end surface 302, as shown in FIG. 5;

(2) providing an elongated first-layer sheet 21 which is made of resin and which has two inclined end surfaces 211 that are parallel to each other, and several fibers 212 that are evenly coated on the sheet 21 and that extend along the length of the sheet 21, as shown in FIG. 5;

(3) winding the first-layer sheet 21 on the shaft 30 in a clockwise direction from the first end surface 301 to the second end surface 302 of the shaft 30 in such a manner that one of the end surfaces 201 of the first-layer sheet 21 and the first end surface 301 the shaft 30 are on a similar plane and that the fibers 212 of the first-layer sheet 21 form an angle of about 48±3 degrees with respect to an axis of the shaft 30 so that, when the first-layer sheet 21 is wound to the second end surface 302 of the shaft 30, the fibers 212 of the first-layer sheet 21 form an angle of about 19±3 degrees with respect to the axis of the shaft 30, as shown in FIGS. 5 and 6;

(4) providing an elongated second-layer sheet 22 (see FIG. 7) which is similar to the first-layer sheet 21;

(5) winding the second-layer sheet 22 on the shaft 30 in a counterclockwise direction from the first end surface 301 to the second end surface 302 of the shaft 30 in the same manner as the first-layer sheet 21 so as to cover the first-layer sheet 21, as shown in FIGS. 7 and 8;

(6) providing an elongated third-layer sheet 23 (see FIG. 9) which is similar to the first-layer sheet 21 and which is wound on the shaft 30 in the same manner as the first-layer sheet 21 so as to cover the second-layer sheet 22;

(7) providing an elongated fourth-layer sheet 24 (see FIG. 9) which is similar to the second-layer sheet 22 and which is wound on the shaft 30 in the same manner as the second-layer sheet 22 so as to cover the third-layer sheet 23;

(8) providing an elongated fifth-layer sheet 25 which is made of resin and which has several fibers that are coated on the fifth-layer sheet 25 and that extend along the length of said fifth-layer sheet 25;

(9) winding the fifth-layer sheet 25 on the shaft 30 in such a manner that the fibers of the fifth-layer sheet 25 are parallel to the axis of the shaft 30 so as to cover the fourth-layer sheet 24, as shown in FIGS. 9 and 10; and

Figure 11:
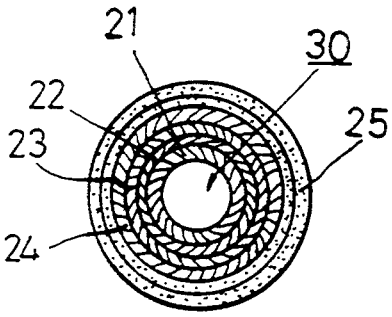
FIG. 11 is a sectional view illustrating the junctions of the sheets of the golf club according to this invention.

(10) pressurizing and heating the assembly of the shaft 30 and the sheets 21, 22, 23, 24, 25 so as to form the shaft unit, as shown in FIG. 11.

Referring to FIG. 11, each of the sheets 21, 22, 23, 24, 25 is in the form of a circular tube. Because no seams are formed between any adjacent two of the shaft 30 and the sheets 21, 22, 23, 24, 25 when the manufacturing method of this invention is performed, there are no cracks produced among the sheets so that the sheets 21, 22, 23, 24, 25 are tightly wound on the shaft 30. The fibers of each adjacent pair of the sheets 21, 22, 23, 24 crisscross each other and the fibers coated on the sheets 21, 22, 23, 24, 25 are longer than those of the sheets of the conventional golf club so that the long-fiber sheets 21, 22, 23, 24, 25 can increase the strength of the golf club. Accordingly, the quality of the shaft unit produced according to the manufacturing method of this invention is better than that produced by the previously described conventional manufacturing method.

With this invention thus explained, it is apparent that numerous modifications and variations can be made without departing from the scope and spirit of this invention. It is therefore intended that this invention be limited only as indicated in the appended claims.

I claim:

1. A method for making a shaft unit of a golf club, comprising the steps:

(1) providing a shaft which is made of metal and which has a first end surface, a second end surface, and a cross-sectional area that increases gradually from said first end surface to said second end surface;

(2) providing an elongated first-layer sheet which is made of resin and which has two inclined end surfaces that are parallel to each other, and several fibers that are coated on said sheet and that extend along a length of said sheet;

(3) winding said first-layer sheet on said shaft in a clockwise direction from said first end surface to said second end surface of said shaft in such a manner that one of said end surfaces of said first-layer sheet and said first end surface of said shaft are on a similar same plane and that said fibers of said first-layer sheet form an angle of about 48±3 degrees with respect to an axis of said shaft so that, when said first-layer sheet is wound to said second end surface of said shaft, said fibers of said first-layer sheet form an angle of about 19±3 degrees with respect to said axis of said shaft;

(4) providing an elongated second-layer sheet which is similar to said first-layer sheet;

(5) winding said second-layer sheet on said shaft in a counterclockwise direction from said first end surface to said second end surface of said shaft in the same manner as said first-layer sheet; and (6) pressurizing and heating assembly of said sheets and said shaft so as to form said golf club.

2. A method for making a shaft unit of a golf club as claimed in claim 1, further comprising between the steps (5) and (6) the substeps of:

(51) providing an elongated third-layer sheet which is similar to said first-layer sheet and which is wound on said shaft in the same manner as said first-layer sheet;

(52) providing an elongated fourth-layer sheet which is similar to said second-layer sheet and which is wound on said shaft in the same manner as said second-layer sheet;

(53) providing an elongated fifth-layer sheet which is made of resin and which has several fibers that are coated on said fifth-layer sheet and that extend along a length of said fifth-layer sheet; and

(54) winding said fifth-layer sheet on said shaft in such a manner that said fibers of said fifth-layer sheet are parallel with said axis of said shaft so as to cover said fourth-layer sheet.

* * * * *